US006489545B1

(12) United States Patent
Hart et al.

(10) Patent No.: US 6,489,545 B1
(45) Date of Patent: Dec. 3, 2002

(54) SOUND PRODUCING DEVICE

(76) Inventors: Richard A. Hart, 6320 Spring Branch Rd., Montgomery, TX (US) 77316; Justin D. Tew, 11 E. Bigelow Oak Ct., The Woodlands, TX (US) 77381

( * ) Notice: Subject to any disclaimer, the term of this patent is extended or adjusted under 35 U.S.C. 154(b) by 5 days.

(21) Appl. No.: 09/586,364

(22) Filed: Jun. 2, 2000

(51) Int. Cl.[7] ..... G10D 13/08

(52) U.S. Cl. ..... 84/402; 446/202; 446/204; 446/207

(58) Field of Search ..... 84/402; 446/207, 446/202, 204; 181/19, 20

(56) References Cited

U.S. PATENT DOCUMENTS

| | | | |
|---|---|---|---|
| 819,076 A | | 5/1906 | Mortensen |
| 2,463,630 A | | 3/1949 | Kimple |
| 2,880,548 A | | 4/1959 | Marr |
| D311,878 S | | 11/1990 | Mingus et al. |
| D330,523 S | | 10/1992 | Killion |
| 5,201,276 A | * | 4/1993 | Knight ..... 116/137 R |
| 6,231,418 B1 | * | 5/2001 | Hancock et al. ..... 446/207 |

FOREIGN PATENT DOCUMENTS

| | | |
|---|---|---|
| EP | 0 295 564 | * 12/1988 |

* cited by examiner

*Primary Examiner*—Shih-Yung Hsieh

(57) ABSTRACT

A sound producing device for producing a whistling sound when placed in the mouth of a user and blown through. The sound producing device includes a sound producing member for placing in the mouth of the user. The sound producing member comprises a first end edge and a second end edge, and first and second side edges extending between the first and second end edges. The sound producing member comprises a first section and a second section. The first and second sections are positioned substantially parallel to each other. The first and second sections are spaced from each other with a gap therebetween. Each of the first and second sections has an aperture through the respective section at a substantially central location of the respective section. A third section of the sound producing member extends between the first and second sections.

15 Claims, 2 Drawing Sheets

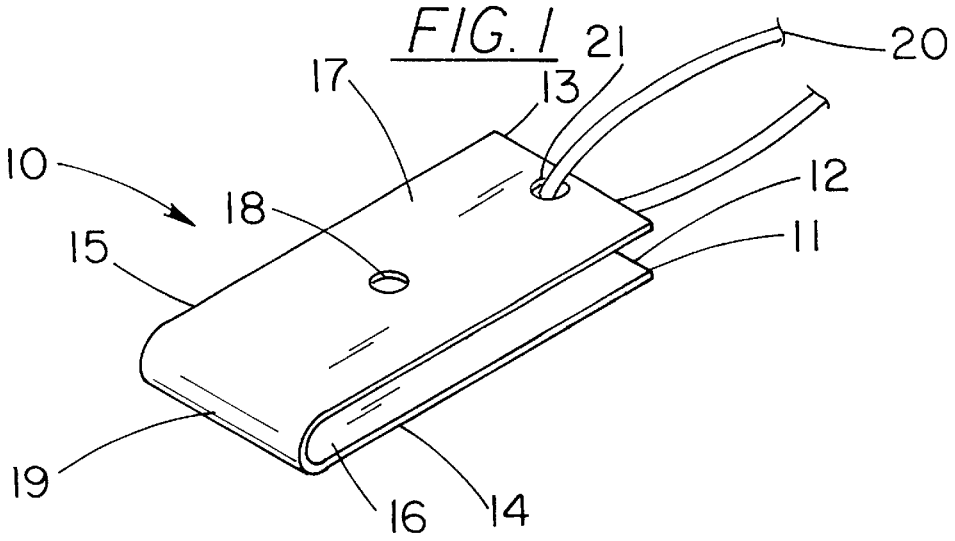
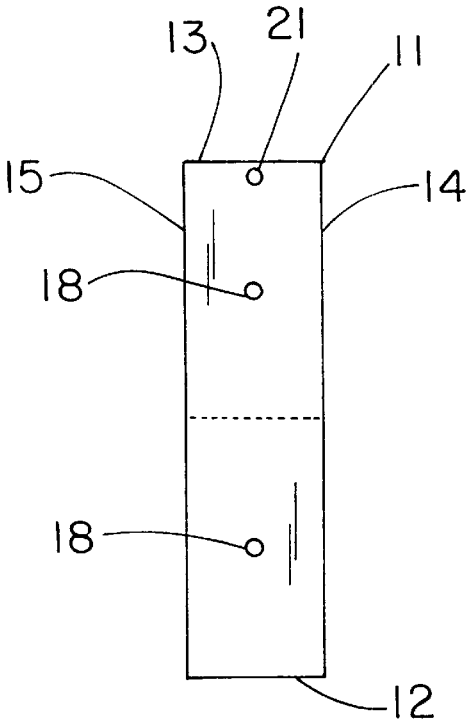
FIG. 2
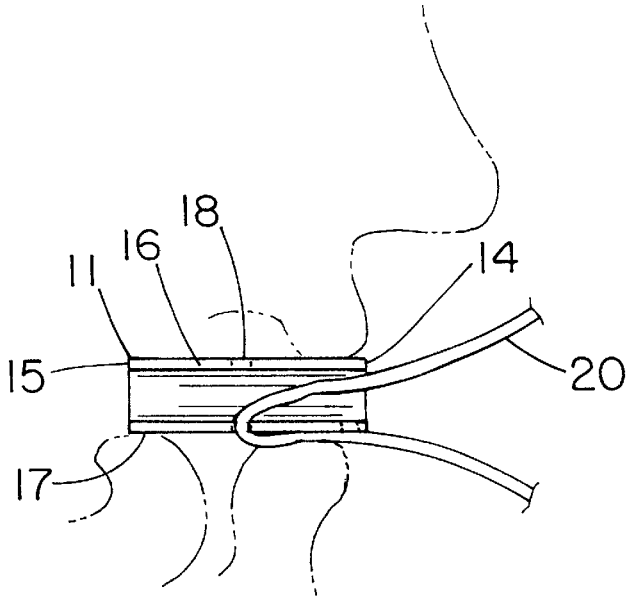
FIG. 3

SOUND PRODUCING DEVICE

BACKGROUND OF THE INVENTION

1. Field of the Invention

The present invention relates to sound producing devices and more particularly pertains to a new sound producing device for producing a whistling sound when placed in the mouth of a user and blown through.

2. Description of the Prior Art

The use of sound producing devices is known in the prior art. More specifically, sound producing devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 819,076; U.S. Pat. No. 2,463,630; U.S. Pat. No. Des. 311,878; U.S. Pat. No. 5,201,276; U.S. Pat. No. 2,880,548; and U.S. Pat. No. Des. 330,523.

While these devices fulfill their respective, particular objectives and requirements, the aforementioned patents do not disclose a new sound producing device. The inventive device includes a sound producing member for placing in the mouth of the user. The sound producing member comprises a first end edge and a second end edge, and first and second side edges extending between the first and second end edges. The sound producing member comprises a first section and a second section. The first and second sections are positioned substantially parallel to each other. The first and second sections are spaced from each other with a gap therebetween for blowing air through. Each of the first and second sections has an aperture through the respective section at a substantially central location of the respective section. A third section of the sound producing member extends between the first and second sections.

In these respects, the sound producing device according to the present invention substantially departs from the conventional concepts and designs of the prior art, and in so doing provides an apparatus primarily developed for the purpose of for producing a whistling sound when placed in the mouth of a user and blown through.

SUMMARY OF THE INVENTION

In view of the foregoing disadvantages inherent in the known types of sound producing devices now present in the prior art, the present invention provides a new sound producing device construction wherein the same can be utilized for producing a whistling sound when placed in the mouth of a user and blown through.

The general purpose of the present invention, which will be described subsequently in greater detail, is to provide a new sound producing device apparatus and method which has many of the advantages of the sound producing devices mentioned heretofore and many novel features that result in a new sound producing device which is not anticipated, rendered obvious, suggested, or even implied by any of the prior art sound producing devices, either alone or in any combination thereof.

To attain this, the present invention generally comprises a sound producing member for placing in the mouth of the user. The sound producing member comprises a first end edge and a second end edge, and first and second side edges extending between the first and second end edges. The sound producing member comprises a first section and a second section. The first and second sections are positioned substantially parallel to each other. The first and second sections are spaced from each other with a gap therebetween for blowing air through. Each of the first and second sections has an aperture through the respective section at a substantially central location of the respective section. A third section of the sound producing member extends between the first and second sections.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new sound producing device apparatus and method which has many of the advantages of the sound producing devices mentioned heretofore and many novel features that result in a new sound producing device which is not anticipated, rendered obvious, suggested, or even implied by any of the prior art sound producing devices, either alone or in any combination thereof.

It is another object of the present invention to provide a new sound producing device which may be easily and efficiently manufactured and marketed.

It is a further object of the present invention to provide a new sound producing device which is of a durable and reliable construction.

An even further object of the present invention is to provide a new sound producing device which is susceptible of a low cost of manufacture with regard to both materials and labor, and which accordingly is then susceptible of low prices of sale to the consuming public, thereby making such sound producing device economically available to the buying public.

Still yet another object of the present invention is to provide a new sound producing device which provides in the apparatuses and methods of the prior art some of the advantages thereof, while simultaneously overcoming some of the disadvantages normally associated therewith.

Still another object of the present invention is to provide a new sound producing device for producing a whistling sound when placed in the mouth of a user and blown through.

Yet another object of the present invention is to provide a new sound producing device which includes a sound producing member for placing in the mouth of the user. The sound producing member comprises a first end edge and a second end edge, and first and second side edges extending between the first and second end edges. The sound producing member comprises a first section and a second section. The first and second sections are positioned substantially parallel to each other. The first and second sections are spaced from each other with a gap therebetween for blowing air through. Each of the first and second sections has an aperture through the respective section at a substantially central location of the respective section. A third section of the sound producing member extends between the first and second sections.

Still yet another object of the present invention is to provide a new sound producing device that provides a user with entertainment by easily producing a whistling sound.

Even still another object of the present invention is to provide a new sound producing device that allows a user to mimic bird calls.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a new sound producing device according to the present invention.

FIG. 2 is a top plan view of the present invention before being folded in half.

FIG. 3 is a side elevational view of the present invention in use.

DESCRIPTION OF THE PREFERRED EMBODIMENT

Figure 4:
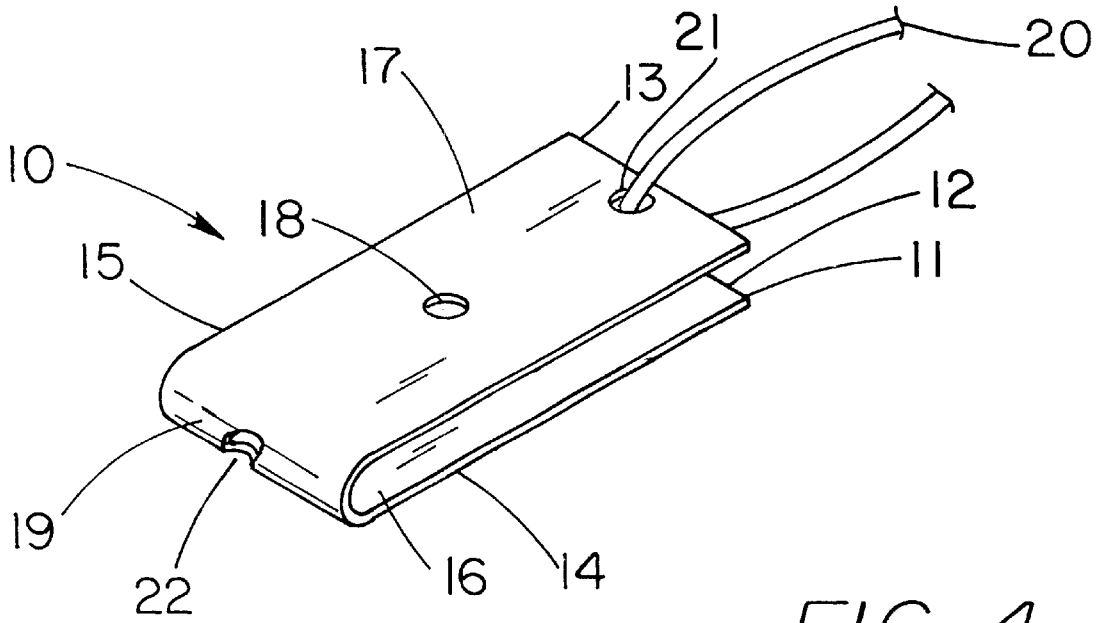
FIG. 4 is a perspective view of an embodiment of the present invention.

With reference now to the drawings, and in particular to FIGS. 1 through 3 thereof, a new sound producing device embodying the principles and concepts of the present invention and generally designated by the reference numeral 10 will be described.

As best illustrated in FIGS. 1 through 3, the sound producing device 10 generally comprises a sound producing member 11 for placing in the mouth of the user. The sound producing member comprises a first end edge 12 and a second end edge 13, and first and second side edges 14,15 extending between the first and second end edges.

The sound producing member comprises a first section 16 and a second section 17. The first and second sections are positioned substantially parallel to each other. The first and second sections are spaced from each other with a gap therebetween for blowing air through. The first and second end edges are located adjacent to each other with the gap therebetween. Each of the first and second sections comprises an aperture 18 through the respective section at a substantially central location of the respective section. The aperture in the first section is substantially axially aligned with the aperture in the second section.

A third section 19 of the sound producing member extends between the first and second sections. The third section is located approximately medially between the first and second end edges. The sound producing member is formed from a substantially rigid material. In an embodiment, as shown in FIG. 4, a secondary aperture 22 is positioned through the third section for changing the vibratory characteristics of the sound producing member.

As shown in FIG. 1, a lanyard 20 is for suspending the sound producing member about a neck of a person. The lanyard comprises a loop formed of an elongate flexible member passing through a hole 21 in one of the sections of the sound producing member. The hole is located adjacent to one of the end edges of the sound producing member.

The distance between one of the end edges of the sound producing member and the third section is approximately one and one-half inches. The distance between the side edges is approximately three-quarters of an inch. Each of the apertures is located approximately three-quarters of an inch away from the closest end edge. Each of the apertures has a diameter of approximately three-sixteenths of an inch.

In use, a sound producing member is provided and placed in the mouth of the user. As shown in FIG. 3, the sound producing member is placed with an upper lip of the user against the first section between the first side edge and the aperture in the first section. A lower lip of the user is placed against the second section between the first side edge and the aperture in the second section. The tongue of the user is. placed against the second section between the second side edge and the aperture in the second section. Air is exhaled through the gap between the first and second sections of the sound producing member to create a whistling sound.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A device for placing in the mouth of a user to produce a whistling sound, the sound producing device comprising:

a sound producing member for placing in the mouth of the user, the sound producing member having a first end edge and a second end edge, and first and second side edges extending between the first and second end edges, the sound producing member comprising:

a first section and a second section, the first and second sections being positioned substantially parallel to each other, the first and second sections being spaced from each other with a gap therebetween for blowing air through; and a third section of the sound producing member extending between the first and second sections;

wherein a first aperture is formed in the first section at a location spaced from the third section, and a second aperture is formed in the third section such that an axis of the second aperture extends substantially parallel to inner surfaces of the first and second sections.

2. The sound producing device as set forth in claim 1, wherein the first and second end edges are located adjacent to each other with the gap therebetween.

3. The sound producing device as set forth in claim 1, additionally comprising a third aperture located in the second section, and wherein the first aperture in the first section is substantially axially aligned with the third aperture in the second section.

4. The sound producing device as set forth in claim 1, wherein the third section is located approximately medially between the first and second end edges.

5. The sound producing device as set forth in claim 1, wherein the sound producing member is formed from a substantially rigid material.

6. The sound producing device as set forth in claim 1, further comprising a lanyard for suspending the member about a neck of a person, the lanyard comprising a loop formed of an elongate flexible member passing through a hole in one of the sections of the sound producing member.

7. The sound producing device as set forth in claim 6, wherein the hole is located adjacent to one of the end edges of the sound producing member.

8. The sound producing device as set forth in claim 1, wherein the distance between one of the end edges of the sound producing member and the third section is approximately one and one-half inches.

9. The sound producing device as set forth in claim 1, wherein the distance between the side edges is approximately three-quarters of an inch.

10. The sound producing device as set forth in claim 3, wherein each of the first and third apertures is located approximately three-quarters of an inch away from the closest end edge.

11. The sound producing device as set forth in claim 1, wherein each of the apertures has a diameter of approximately three-sixteenths of an inch.

12. A device for placing in the mouth of a user to produce a whistling sound, the sound producing device comprising:

a sound producing member for placing in the mouth of the user, the sound producing member having a first end edge and a second end edge, and first and second side edges extending between the first and second end edges, the sound producing member comprising:

a first section and a second section, the first and second sections being positioned substantially parallel to each other, the first and second sections being spaced from each other with a gap therebetween for blowing air through, the first and second end edges being located adjacent to each other with the gap therebetween;

a third section of the sound producing member extending between the first and second sections, the third section being located approximately medially between the first and second end edges, the sound producing member being formed from a substantially rigid material;

wherein a first aperture is formed in the first section at a location spaced from the third section, and a second aperture is formed in the third section such that an axis of the second aperture extends substantially parallel to inner surfaces of the first and second sections;

a lanyard for suspending the member about a neck of a person, the lanyard comprising a loop formed of an elongate flexible member passing through a hole in one of the sections of the sound producing member, the hole being located adjacent to one of the end edges of the sound producing member; and wherein the distance between one of the end edges of the sound producing member and the third section is approximately one and one-half inches, wherein the distance between the side edges is approximately three-quarters of an inch, wherein the first aperture is located approximately three-quarters of an inch away from the closest end edge, wherein each of the apertures has a diameter of approximately three-sixteenths of an inch;

wherein the axis of the second aperture is oriented substantially perpendicular to an axis of the first aperture; and wherein the second aperture is located substantially centrally between the first and second side edges.

13. A method of producing a whistling sound, comprising:

providing a sound producing member for placing in the mouth of the user, a first section and a second section, the first and second sections being positioned substantially parallel to each other, the first and second sections being spaced from each other with a gap therebetween, the sound producing member having first and second side edges, a first aperture being formed in the first section at a location spaced from the third section, and a second aperture being formed in the third section such that an axis of the second aperture extends substantially parallel to inner surfaces of the first and second sections;

placing the sound producing member in the mouth of a user;

placing an upper lip of the user against the first section between the first side edge and the first aperture in the first section;

placing a lower lip of the user against the second section;

placing the tongue of the user against the second section; and exhaling air through the gap between the first and second sections of the sound producing member.

14. The sound producing device as set forth in claim 1, wherein the axis of the second aperture is oriented substantially perpendicular to an axis of the first aperture.

15. The sound producing device as set forth in claim 1, wherein the second aperture is located substantially centrally between the first and second side edges.

* * * * *